US005955792A

United States Patent [19]

Fischer et al.

[11] Patent Number: 5,955,792

[45] Date of Patent: Sep. 21, 1999

[54] METHOD AND DEVICE FOR DRIVING A LOAD

[75] Inventors: Werner Fischer, Heimsheim; Birte Luebbert, Stuttgart, both of Germany

[73] Assignee: Robert Bosch GmbH, Stuttgart, Germany

[21] Appl. No.: 08/966,512

[22] Filed: Nov. 10, 1997

[30] Foreign Application Priority Data

Nov. 8, 1996 [DE] Germany ..... 196 46 052

[51] Int. Cl.[6] ..... H01H 47/32

[52] U.S. Cl. ..... 307/87; 307/131; 327/108; 327/110; 361/93; 361/152

[58] Field of Search ..... 307/87, 131; 327/108, 327/110, 139; 361/93, 143, 152, 31; 323/285

[56] References Cited

U.S. PATENT DOCUMENTS

| | | | |
|---|---|---|---|
| 3,736,473 | 5/1973 | Pugh | 361/152 |
| 4,178,619 | 12/1979 | Seiler et al. | 361/93 |
| 4,400,756 | 8/1983 | Cave et al. | 361/152 |
| 4,736,267 | 4/1988 | Karlmann et al. | 323/285 |
| 5,140,515 | 8/1992 | Menniti et al. | 363/98 |
| 5,390,070 | 2/1995 | Niedermeier | 361/152 |

FOREIGN PATENT DOCUMENTS

| | | |
|---|---|---|
| 28 40 192 | 3/1980 | Germany . |
| 44 14 609 | 11/1995 | Germany . |

*Primary Examiner*—Albert W. Paladini
*Attorney, Agent, or Firm*—Kenyon & Kenyon

[57] ABSTRACT

A method and a device for driving a load, particularly an electromagnetic load. The current flowing through the load is detected, and is controlled by a control device connected in series to the load. During a first phase, in addition to the control device, a first switching device is driven that is disposed parallel to the control device. During a third phase, in addition to the control device, a second switching device is driven that is disposed parallel to the control device.

10 Claims, 2 Drawing Sheets

METHOD AND DEVICE FOR DRIVING A LOAD

BACKGROUND INFORMATION

A method and device for driving an electromagnetic load are described, for example, in German Patent No. 44 14 609. The current flowing through the load is measured and adjusted to a setpoint value. A control means connected in series to the load is driven as a function of the current flowing through the load. Furthermore, a switching means is disposed parallel to the control means.

German Patent No. 28 40 192 describes, before the actual driving, to adjust the current flowing through a solenoid valve to a value which is not yet sufficient to actuate the solenoid valve.

Usually, power transistors are used as the switching means. If the current is adjusted by means of an analog automatic control, a very high dissipation power develops in the power transistor. The power consumption of transistors is essentially a function of the maximum permissible temperature and the degree of thermal coupling to the ambient environment.

Only two current levels with low power loss can be realized with the known device. Furthermore, a rapid circuit closing is not easily achievable.

SUMMARY OF THE INVENTION

An object of the present invention is to point out a possibility as to how the power loss of the power transistor can be reduced at different current levels.

Power transistors with substantially lower maximum power consumption, and thus less expensive transistors, can be used in the device according to the present invention.

DETAILED DESCRIPTION

In the exemplary embodiment, the load is the coil of a solenoid valve which influences the metering of fuel into an internal combustion engine. By driving this solenoid valve, the start of injection, the end of injection, and thus also the amount of injected fuel can be controlled. To this end, it is necessary for the solenoid valve to open and/or close at a defined point of time. Furthermore, particularly in the case of self-ignition internal combustion engines, it is advantageous if the solenoid valve reaches its new end position as quickly as possible after the output of the driving signal.

Figure 1:
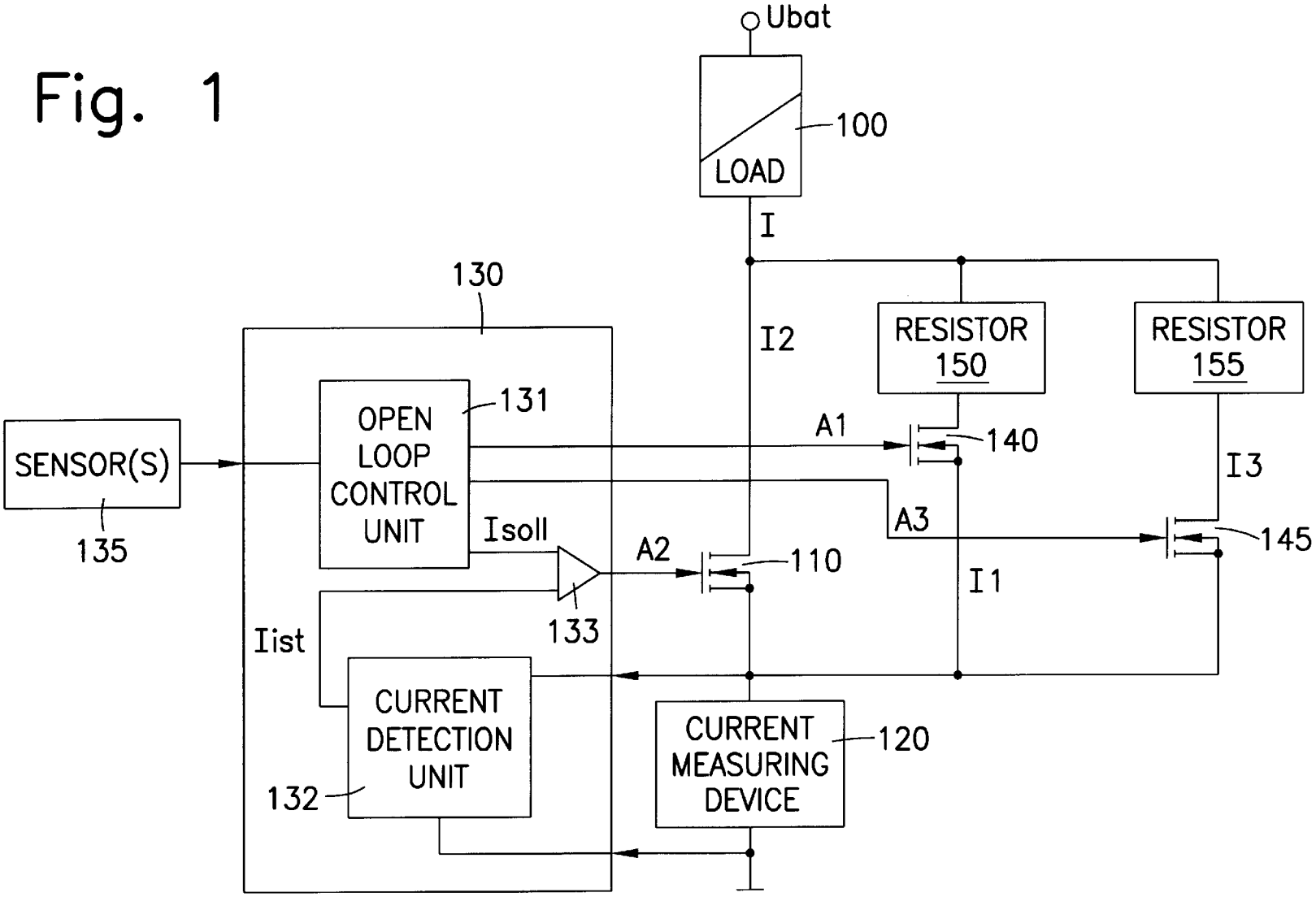
FIG. 1 shows schematically the device according to the present invention.

In FIG. 1, the elements of the device according to the present invention are shown schematically. The electromagnetic load is designated by 100. It is connected with its first connection terminal to battery voltage Ubat. With its second connection terminal, it is connected to a control means 110.

Control means 110 is preferably a transistor, particularly a field-effect transistor. In this case, the second connection terminal of the load is connected to the drain terminal of field-effect transistor 110. The source terminal of transistor 110 is connected to a current-measuring means 120 for detecting the current flowing through the load. The second connection terminal of current-measuring means 120 is connected to ground.

The arrangement of these three elements is shown only by way of example. Thus, these elements can also be arranged in another order. Thus, for example, ground and battery connection terminals can be interchanged.

The interconnection point between the second connection terminal of load 100 and control means 10 is connected to the first connection terminal of a first resistor 150. The second connection terminal of resistor 150 is connected to a first switching means 140. Preferably a transistor, particularly a field-effect transistor, is used as switching means 140. In this case, the second connection terminal of resistor 150 is connected to the drain terminal of transistor 140. The source terminal of transistor 140 is in contact with the interconnection point between control means 110 and current-measuring means 120. Switching means 140 is essentially connected in parallel to control means 110.

The interconnection point between the second connection terminal of load 100 and control means 110 is furthermore connected to the first connection terminal of a second resistor 155. The second connection terminal of resistor 155 is connected to a second switching means 145. Preferably a transistor, particularly a field-effect transistor, is used as switching means 145. In this case, the second connection terminal of resistor 155 is connected to the drain terminal of transistor 145. The source terminal of transistor 145 is in contact with the interconnection point between control means 110 and current-measuring means 120. Switching means 145 is essentially connected in parallel to control means 110.

The gate terminals of transistors 140 and 145, as well as the gate terminal of transistor 110 receive driving signals from an open-loop control unit 131.

Preferably, current-measuring means 120 is implemented as a resistor. The two connection terminals of resistor 120 are sampled by control unit 130. The two voltage values are fed to a current detection unit 132 which makes available an actual current value Iactual on the basis of the voltage drop at resistor 120. This actual value Iactual is fed as an actual value to an automatic controller 133. The second connection terminal of automatic controller 133 is connected to open-loop control 131 which acts upon the second input with a setpoint value Isetpoint. The output of automatic controller 133 acts upon the gate of transistor 110 with a corresponding signal.

To form the driving signals, control unit 130 evaluates different output signals of sensors 135.

Figure 2A:
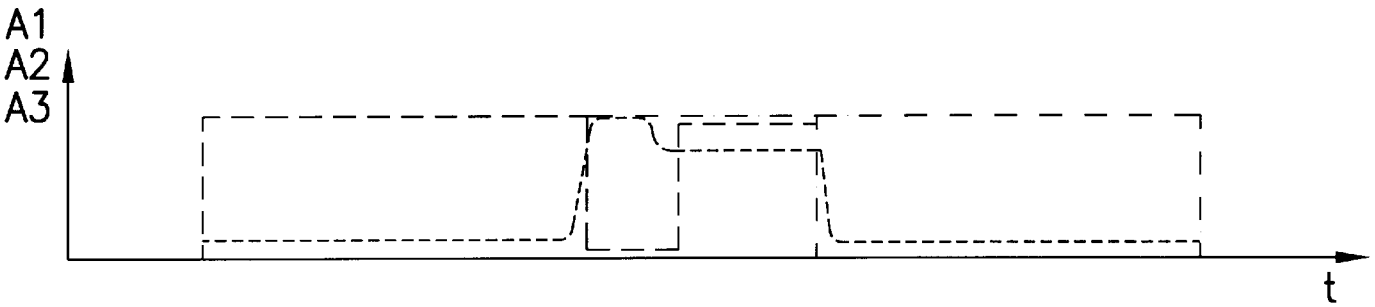
FIG. 2*a* shows various signals occurring in the device, plotted over time.
Figure 2B:
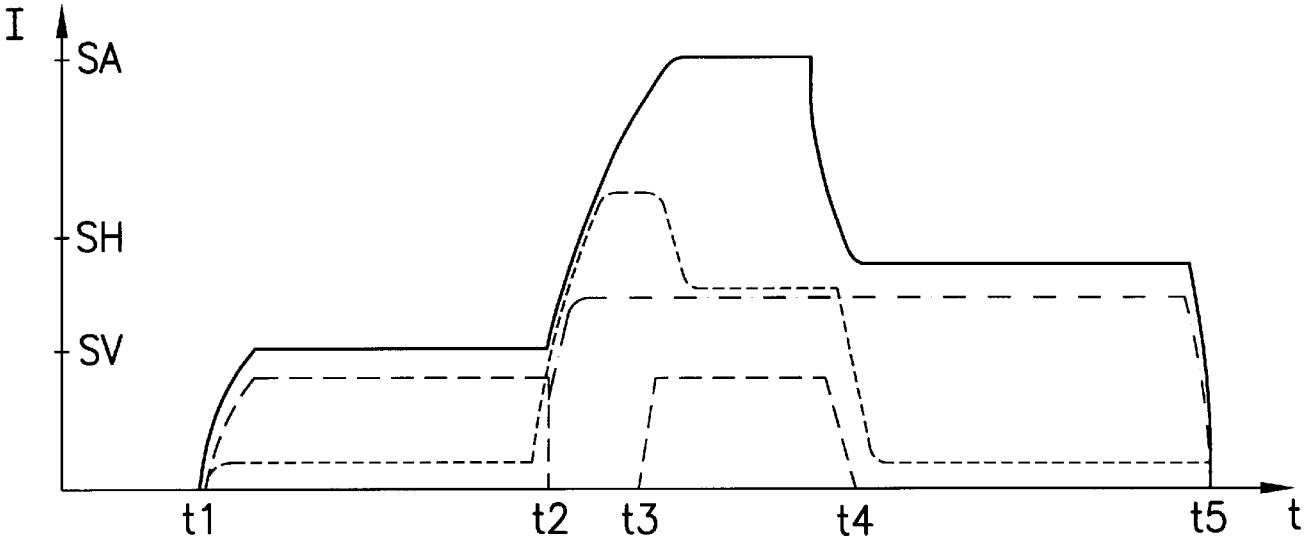
FIG. 2*b* shows further signals occurring in the device, plotted over time.

The functioning method of this device is described in the following with reference to FIGS. 2*a* and 2*b*. In FIG. 2*a*, the driving signals for control means 110 are plotted with a dotted line, the driving signal for the first switching means 140 is plotted with a broken line, and for the second switching means 145 with a dot-dash line. In FIG. 2*b*, current I2 which flows through control means 110 is plotted with a dotted line, current I1 which flows through first switching means 140 is plotted as a broken line, current I3 which flows through second switching means 145 is plotted with a dot-dash line, and the total current I which flows through solenoid valve 100 is plotted as a solid line.

In a first phase before the driving of the solenoid valve, switching means 140 is driven at point of time t1 in such a way that it releases the current flow. At the same time, a first setpoint value SV is preset by open-loop control 131. In this context, resistor 150 is so dimensioned that the current flowing through the branch comprised of resistor 150 and switching means 140 suffices for the premagnetization. The control means is driven by automatic controller 133 in such a way that the current which flows through load 100 corresponds to setpoint value SV. This setpoint value SV is so preset that the load is premagnetized, but its position does not yet change. If the drive pulse takes place at point of time t2, the load reaches its new position substantially faster because of the premagnetization.

At point of time t1, driving signal A1, indicated with a broken line, for the first switching means is set to its high level. As a result, current I1 which flows through first switching means 140 rises almost to value SV. Driving signal A2, indicated with a dotted line, is preset by automatic controller 133 in such a way that the total current I which flows through load 100 assumes the value SV. During this phase, the substantial component of the total current of current I1 which flows through first switching means 140 is made available.

In the second phase, as of the start of driving at point of time t2, driving signal A1 is withdrawn and driving signal A2 is set at its maximum value. As a result, current I2 which flows through current control means 110 rises sharply. Current I, which flows through the solenoid valve, rises to the setpoint value for the inrush current SA. Current I1, on the other hand, drops to zero. Virtually the entire current I which flows through the load is made available by current I2 which flows through control means 110. The setpoint value SA is so selected that the valve changes its position quickly.

In the third phase, as of point of time t4, driving signal A3, indicated with a dot-dash line, for second switching means 145 is set at its high level. As a result, current I3 which flows through second switching means 145 rises almost to value SH. Driving signal A2, indicated with a dotted line, is preset by automatic controller 133 in such a way that the total current I which flows through load 100 assumes the value SH. Setpoint value SH is also designated as the hold current; it is so selected that the valve remains in its position.

During this phase, the substantial component of the total current of the current which flows through second switching means 145 is made available.

At point of time t5, the driving of the solenoid valve ends. This means, for example, that switching means 145 is opened and control means 110 is so driven that the current flowing through switching means 145 falls to zero. The current through control means 110 likewise drops.

In a particularly advantageous refinement of the present invention, in the second phase, driving signal A3, indicated with a dot-dash line, for second switching means 145 is set to its high level. As a result, current I3 which flows through the second switching means rises almost to value SH. It is particularly advantageous if, as of point of time t3, driving signal A1 for first switching means 140 is also set to its high level. As a result, current I1 flowing through the first switching means rises almost to value SV.

This driving of switching means 140 and 145 in the second phase is only by way of example. It is particularly advantageous if, during the second phase between points of time t2 and t4, switching means 140 and 145 are driven selectively or both together, so that the inrush current is obtained essentially from currents I1 and I3 which flow through switching means 140 and 145. In this specific embodiment, only a small component of the total current must be obtained from control means 110.

Resistor 150 is so dimensioned that, from point of time t1 to point of time t2, the greatest current component flows through switching means 140 and resistor 150. Only a small current component flows via control means 110. This is achieved in this manner, that during the period of time between t1 and t2, the branch comprised of resistor means 150 and switching means 140 exhibits a smaller resistance than control means 110.

This means that the branch comprised of resistor means 150 and switching means 140 also receives the greatest portion of the dissipation power.

Resistor 155 is so dimensioned that, as of point of time t4, the greatest current component flows through switching means 145 and resistor 155. Only a small current component flows via control means 110. This is achieved in this manner, that during the period of time between t4 and t5, the branch comprised of resistor means 155 and switching means 145 exhibits a smaller resistance than control means 110.

This means that the branch comprised of resistor means 155 and switching means 145 also receives the greatest portion of the dissipation power.

Switching means 140 and 145 are each fully switched-through and function as switches. The greatest portion of the current flows in each case through switching means 140 and 145. The respective branch comprised of resistor 150 and 155 respectively and switching means 140 and 145 respectively also receives the greatest portion of the dissipation power. Control means 110 functions as an analog current controller. Control means 110 receives the differential current between the setpoint value and the current which flows through the respective switching means 140 and 145.

The substantial portion of the energy dissipation is converted in resistors 150 or 155 and not in a transistor. Compared to transistors, resistors can be designed at the same cost for substantially higher temperatures. A good thermal coupling to the ambient environment or to heat sinks can be attained with low expenditure. The driving of the output stages is simple compared to the circuit expenditure necessary when the dissipation power is distributed over a plurality of power transistors.

Power resistors 150 and 150 do not need to have a narrow tolerance, since control means 110 regulates the current. Furthermore, resistors 150 and 155 can be mounted externally of the control unit, e.g. near load 100.

What is claimed is:

1. A method for driving a load, comprising the steps of:

during a first phase of a three-phase driving process, driving a control device and a first switching device disposed parallel to the control device being controlled as a function of a current flowing through the load;

performing a second phase of the three-phase driving process; and during a third phase of the three-phase driving process, driving the control device and a second switching device disposed parallel to the control device.

2. The method according to claim 1, wherein the load is an electromagnetic load.

3. The method according to claim 1, further comprising the step of detecting the current flowing through the load.

4. The method according to claim 1, wherein the control device is controlled as a function of a comparison between the current flowing through the load and a desired current.

5. The method according to claim 1, wherein the current flowing through the load is adjusted to a first setpoint value during the first phase, to a second setpoint value during a second phase, and to a third setpoint value during the third phase.

6. The method according to claim 5, wherein, during the first phase, before a driving of the load, a position of the load remains constant and a large current component flows through the first switching device.

7. The method according to claim 5, wherein, during the second phase, at a start of a driving of the load, a position of the load changes and a large current component flows through the control device.

8. The method according to claim 5, wherein, during the third phase, a position of the load is maintained and a large current component flows through the second switching device.

9. A device for driving a load, comprising:

means for detecting a current flowing through the load;

a control device connected in series with the load, the control device being controlled as a function of the current flowing through the load;

first and second switching devices disposed parallel to the control device; and means for driving the control device and the first switching device during a first phase of a three-phase driving process, and for driving the control device and the second switching device during a third phase of the three-phase driving process, the three-phase driving process including a second phase.

10. The device according to claim 9, wherein the load is an electromagnetic load.

* * * * *